US005457297A

United States Patent [19]

Chen

[11] Patent Number: 5,457,297

[45] Date of Patent: Oct. 10, 1995

[54] COMPUTER KEYBOARD KEY SWITCH

[76] Inventor: Pao-Chin Chen, 4F, No. 292, Sec. 2, Chien Kuo S. Rd., Taipei, Taiwan

[21] Appl. No.: 230,128

[22] Filed: Apr. 20, 1994

[51] Int. Cl.[6] ..... H01H 3/12

[52] U.S. Cl. ..... 200/344

[58] Field of Search ..... 200/344, 517

[56] References Cited

U.S. PATENT DOCUMENTS

| | | | |
|---|---|---|---|
| 4,433,225 | 2/1984 | Cowles | 200/344 |
| 4,580,022 | 4/1986 | Oelsch et al. | 200/344 |
| 4,902,862 | 2/1990 | Oelsch et al. | 200/344 |
| 5,278,372 | 1/1994 | Takagi et al. | 200/344 |

*Primary Examiner*—Renee S. Luebke
*Attorney, Agent, or Firm*—Bucknam and Archer

[57] ABSTRACT

A computer keyboard key switch which includes a bottom support board, a membrane circuit supported on the support board, a key base having a rubber cone and supported on the membrane circuit, a bridging device supporting board supported on the key base, a key cap, and a bridging device connected between the key cap and the bridge device supporting board and consisting of two rectangular open frames pivotally connected into a crossed form for permitting the key cap to be depressed to compress the rubber cone causing it to trigger the membrane circuit.

2 Claims, 3 Drawing Sheets

COMPUTER KEYBOARD KEY SWITCH

BACKGROUND OF THE INVENTION

The present invention relates to key switches, and more particularly to a key switch for computer keyboards.

A variety of computers are known, and have been widely used in different fields for different purposes. A computer of any type is generally equipped with a keyboard for data input. The key switches of the keyboard of a computer system are generally comprised of a key cap having a plunger, conductive rubber disposed above a membrane circuit and compressed by the plunger to trigger the membrane circuit causing it to produce an electric signal to the computer. During the operation of the keyboard, if the user simply touches the border or any corner of the key cap, the key cap may not move the plunger down causing a key-in error. Furthermore, in order to allow the key cap to return quickly to its former position, a spring may be used. However, the use of the spring does not permit the height of the key switch to be reduced.

SUMMARY OF THE INVENTION

The object of the present invention is to provide a computer keyboard key switch which eliminates the aforesaid drawbacks. According to the present invention, the computer keyboard key switch comprises a bottom support board, a membrane circuit supported on the bottom support board, a key base having a rubber cone and supported on the membrane circuit, a bridging device supporting board supported on the key base, a key cap, and-a bridging device connected between the key cap and the bridge device supporting board. The bridging device comprises two rectangular open frames pivotally connected into a crossed form and linked between the key cap and the bridging device supporting board, and therefore the key cap can be depressed to compress the rubber cone causing it to trigger the membrane circuit.

DETAILED DESCRIPTION OF THE PREFERRED EMBODIMENT

Figure 1:
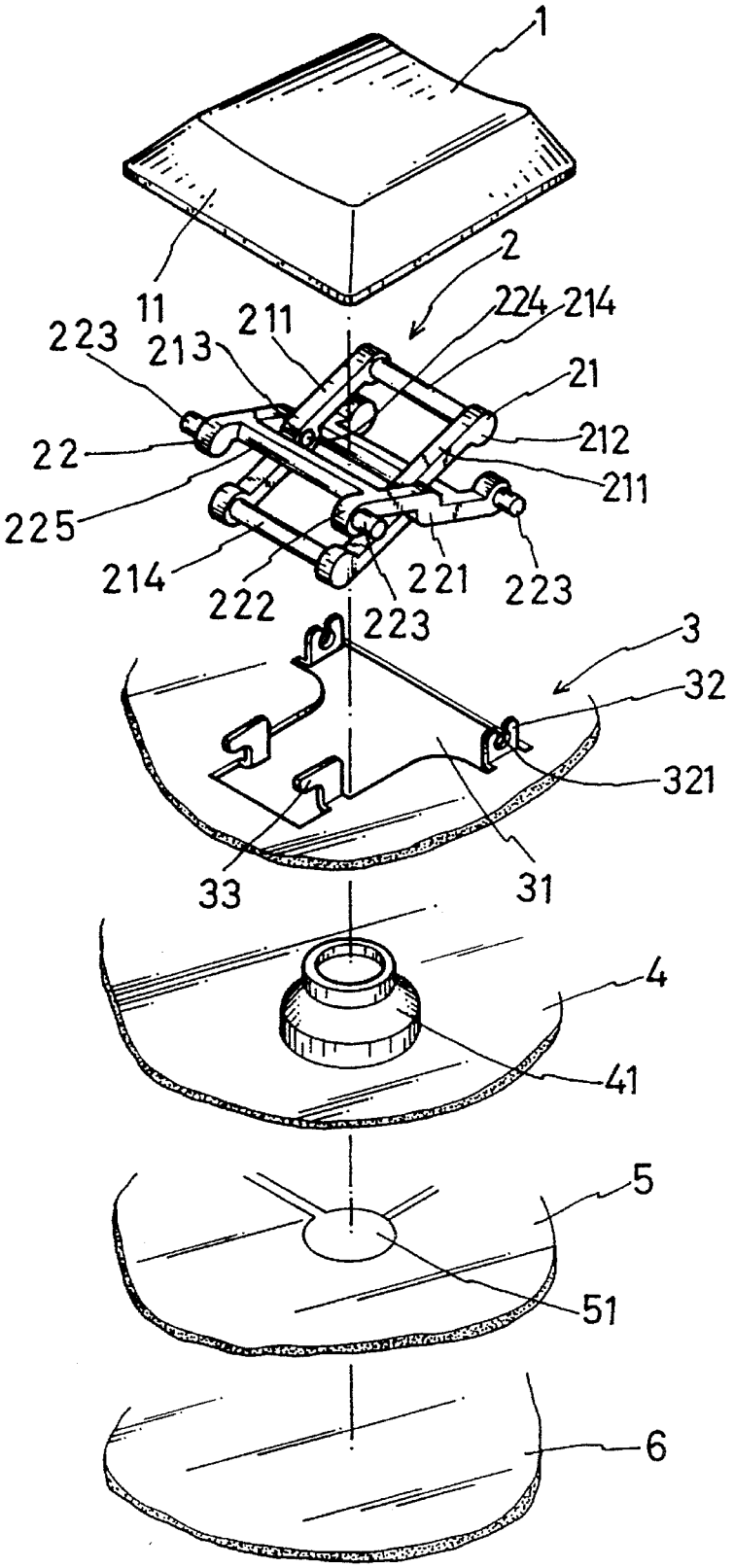
FIG. 1 is an exploded view of a computer keyboard key switch according to the present invention.
Figure 2:
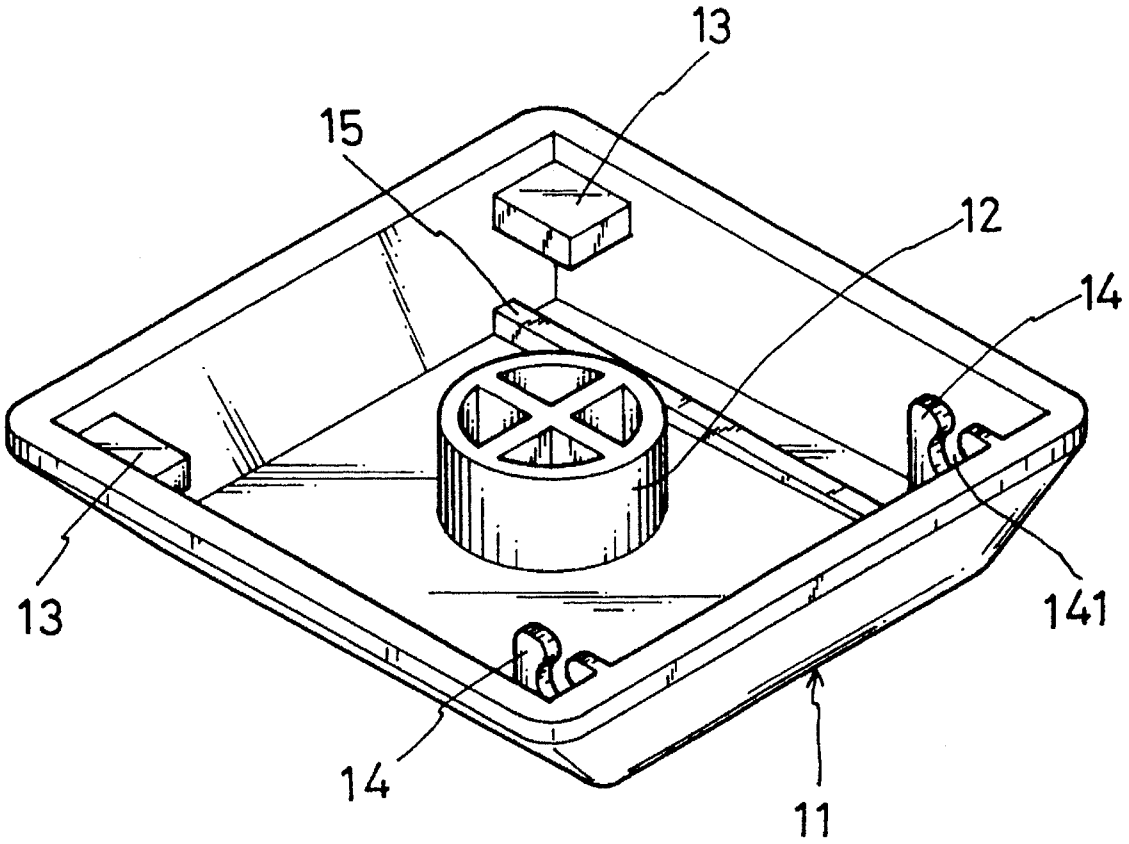
FIG. 2 is an elevational bottom view of the key cap of the computer keyboard key switch shown in FIG. 1.
Figure 3:
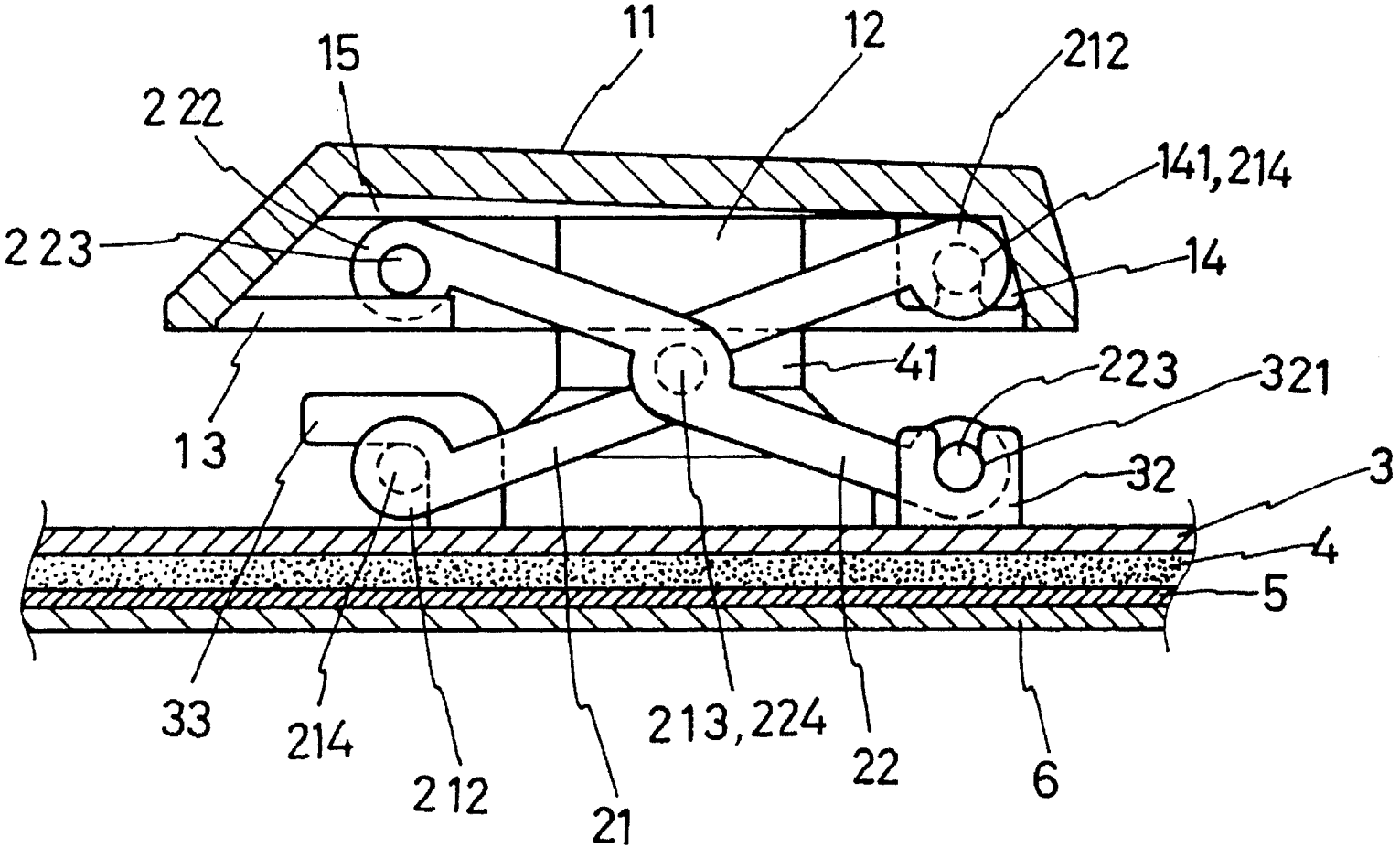
FIG. 3 is a sectional view of the computer keyboard key switch shown in FIG. 1, taken in the vertical direction.

Referring to FIGS. 1, 2, and 3, a computer keyboard key switch in accordance with the present invention is generally comprised of a key cap 1, a bridging device 2, a bridging device supporting board 3, a key base 4, a membrane circuit 5, and a bottom support board 6. The key cap 1 is of integrally molded plastics, comprised of a cap body 11 having a smoothly curved top with the periphery sloping downwardly at four sides, a plunger 12 vertically extending downwardly from the center of the cap body 11, two horizontal strips 13 and two vertical rod retainers 14 disposed within the cap body 11 at the four corners, and two parallel ribs 15 bilaterally raised from the inside wall of the cap body 11 and respectively disposed in parallel with the horizontal strips 13, wherein the vertical rod retainers rods 14 each have a retaining hole 141 at the end thereof. The retaining hole 141 is formed substantially of circular shape having a small mouth extending to the outside. The bridging device supporting board 3 comprises an opening 31, two opposite vertical rod retainers 32 and two opposite hooks 33 respectively disposed at two opposite sides of the opening 31, wherein the vertical rod retainers 32 each have a retaining hole 321 at the end thereof. The bridging device 2 is comprised of a first rectangular open frame 21 and a second rectangular open frame 22 pivotally connected together into a crossed form. The first rectangular open frame 21 comprises two parallel rods 211 and two transverse rods 214 respectively connected between two opposite ends 212 of the parallel rods 211. The parallel rods 211 each have a pin hole 213 in the middle for mounting the second rectangular open frame 22. The second rectangular open frame 22 comprises two parallel rods 221 and two transverse rods 225 connected between the parallel rods 221, four outward pins 223 respectively outwardly extending from the opposite ends 222 of the parallel rods 221 and respectively fastened to the retaining holes 141 or 321 on the vertical rod retainers 14 and 32, two inward pins 224 respectively inwardly extending from the parallel rods 221 in the middle and respectively inserted into the pin holes 213 on the parallel rods 211 of the first rectangular open frame 22. The key base 4 is molded from silicon rubber or the like and supported on the membrane circuit 5 above the bottom support board 6, having a unitary rubber cone 41 protruding through the opening 31 on the bridging device supporting board 3. The membrane circuit 5 has a circuit contact 51 disposed beneath the rubber cone 41 of the key base 4.

Referring to FIG. 3, when assembled, the transverse rods 214 of the first rectangular open frame 21 of the bridging device 2 are respectively fastened to the hooks 33 of the bridging device supporting board 3 and the retaining holes 141 of the vertical rod retainers 14 of the key cap 1, the outward pins 223 of the second rectangular open frame 22 are respectively retained by the horizontal strips 13 ( between the horizontal strips 13 and the parallel ribs 15) of the key cap 1 and the retaining holes 321 on the vertical rod retainers strips 32 of the bridging device supporting board 3, and the rubber cone 41 of the key base 4 projects into the opening 31 on the bridging device supporting board 3 and stops at the bottom of the plunger 12.

Referring to FIG. 3 again, when the key cap 1 is depressed to lower the plunger 12, the rubber cone 41 is compressed by the plunger 12 to trigger the contact 51 causing the membrane circuit 5 to produce an electric signal to the computer. Because two outward pins 223 of the second rectangular open frame 22 are fastened to the retaining holes 321 of the bridging device supporting board 3 and one transverse rod 214 of the first rectangular open is fastened to the retaining holes 141 of cap body 11, depressing the key cap 1 causes the transverse rods 214 of the first rectangular open frame 21 to move toward the outward pins 223 of the second rectangular open frame 22 in the reversed directions, and therefore the plunger 12 of the key cap 1 can be moved downwardly to compress the rubber cone 4, causing the membrane circuit 5 to be triggered. When the pressure is released from the key cap 1, the rubber cone 41 immediately returns to its former shape causing the key cap 1 to return to its former position.

Because the bridging device supporting board 3 is fastened to the bottom support board 6 and supported on the key base 4 above the membrane circuit 5 and, the bridging device 2 is connected between the key cap 1 and the bridging device supporting boards at eight bearing points, the key cap 1 does not deviate from the course when depressed. Because the bridging device 2 is comprised of the first rectangular open frame 21 and the second rectangular open frame 22 pivotally connected in a crossed form, the key cap 1 is constantly supported in a horizontal position when depressed. Furthermore, the design of the bridging device 2 can greatly reduce the total height of the computer key switch.

While only one embodiment of the present invention has been shown and described, it will be understood that various modifications and changes could be made without departing from the spirit and scope of the invention. For example, the rubber cone 41 may be separately prepared and mounted on the contact 41 of the membrane circuit 5.

What is claimed is:

1. A computer keyboard key switch comprising:

a key cap having a plunger vertically downwardly extending from a cap body thereof at a center thereof, two opposite horizontal strips and two opposite vertical rod retainers disposed within said cap body at four corners, and two parallel ribs bilaterally raised from said cap body on an inside thereof and respectively disposed in parallel with said horizontal strips, the rod retainers of said key cap each having a retaining hole;

a flat bottom support board;

a membrane circuit mounted on said flat bottom support board and having an electric contact;

a rubber cone supported on said membrane circuit and compressed by said plunger to contact said electric contact causing said membrane circuit to produce an electric signal;

a bridging device supporting board supported above said membrane circuit, said bridging device supporting board comprising an opening, which receives said rubber cone, two opposite vertical rod retainers and two opposite hooks respectively disposed at four corners around said opening, the rod retainers of said bridging device supporting board each having a retaining hole; and a bridging device connected between said bridging device supporting board and said key cap and bridged over the opening on said bridging device supporting board, said bridging device comprised of a first rectangular open frame and a second rectangular open frame pivotally connected together into a crossed form, said first rectangular open frame comprising a pair of first parallel rods, a first transverse rod connected between said first pair of parallel rods and retained to said hooks on said bridging device supporting board, a second transverse rod connected between said pair of first parallel rods and fastened to the retaining holes on said vertical rod retainers of said key cap, said second rectangular open frame comprising a pair of second parallel rods, connected by a pair of transverse rods, four outward pins extending outwardly from opposite ends of said pair of second parallel rods, two of said pins being disposed between said horizontal strips and said parallel ribs of said cap body, and another two of said pins being fastened to the retaining holes on the vertical rod retainers of said bridging device supporting board, said pair of second parallel rods each having an inward pin in a center thereof inserted into a respective pin hole on said pair of first parallel rods.

2. The computer keyboard key switch of claim 1 wherein said rubber cone is integrally molded on a flat key base retained between said membrane circuit and said bridging device supporting board.

* * * * *